US009293113B2

(12) United States Patent
Yoshie

(10) Patent No.: US 9,293,113 B2
(45) Date of Patent: Mar. 22, 2016

(54) IMAGE PROCESSING APPARATUS AND CONTROL METHOD THEREOF

(71) Applicant: CANON KABUSHIKI KAISHA, Tokyo (JP)

(72) Inventor: Ryoji Yoshie, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 33 days.

(21) Appl. No.: 14/274,324

(22) Filed: May 9, 2014

(65) Prior Publication Data

US 2014/0333659 A1 Nov. 13, 2014

(30) Foreign Application Priority Data

May 13, 2013 (JP) ..... 2013-101114

(51) Int. Cl.
*G09G 5/02* (2006.01)

(52) U.S. Cl.
CPC ..... *G09G 5/02* (2013.01); *G09G 2320/0606* (2013.01); *G09G 2320/0666* (2013.01)

(58) Field of Classification Search
CPC ..... G09G 2320/0666; G09G 2320/0626; G09G 2320/0693; G09G 2320/0673; G09G 2320/0276; G09G 2320/066; G09G 2320/08; G09G 2340/06; G09G 5/06; G09G 2320/0242; G09G 2320/0285; G09G 2320/02; G09G 3/3406; G09G 2320/0233; G09G 2320/06
See application file for complete search history.

(56) References Cited

U.S. PATENT DOCUMENTS 6,466,334 B1 * 10/2002 Komiya et al. ..... 358/1.9
7,009,640 B1 * 3/2006 Ishii et al. ..... 348/223.1

FOREIGN PATENT DOCUMENTS

JP H06-333001 A 12/1994
JP 2005-109583 A 4/2005
JP 2009-089364 A 4/2009

* cited by examiner

*Primary Examiner* — Jeffrey Chow
(74) *Attorney, Agent, or Firm* — Cowan, Liebowitz & Latman, P.C.

(57) ABSTRACT

An image processing apparatus includes a storage unit configured to store respective profiles representing visual characteristics of each of a plurality of persons; and a correction unit configured to perform color correction processing on image data on the basis of the plurality of profiles corresponding to the plurality of persons stored in the storage unit.

16 Claims, 15 Drawing Sheets

FIG. 5

| REFERENCE COLOR CHART (SAMPLE COLORS) | | | CHROMATICITY DIFFERENCE VALUES | | |
|---|---|---|---|---|---|
| L* | a* | b* | L* | a* | b* |
| 0.0 | 0.0 | 0.0 | 0.0 | 0.0 | 0.0 |
| 10.0 | 0.0 | 0.0 | 0.0 | 0.2 | 0.3 |
| 20.0 | 0.0 | 0.0 | 0.0 | 1.0 | 0.6 |
| 30.0 | 0.0 | 0.0 | 0.0 | 1.2 | 0.7 |
| 40.0 | 0.0 | 0.0 | 0.0 | 1.6 | 0.7 |
| 50.0 | 0.0 | 0.0 | 0.0 | 1.7 | 0.9 |
| 60.0 | 0.0 | 0.0 | 0.0 | 2.0 | 1.0 |
| 70.0 | 0.0 | 0.0 | 0.0 | 2.1 | 1.1 |
| 80.0 | 0.0 | 0.0 | 0.0 | 2.5 | 1.2 |
| 90.0 | 0.0 | 0.0 | 0.0 | 2.8 | 1.4 |
| 100.0 | 0.0 | 0.0 | 0.0 | 3.0 | 1.5 |

FIG. 6

| REFERENCE COLOR CHART (SAMPLE COLORS) | | | PERSONAL CHROMATICITY COORDINATE VALUES OF OBSERVER A | | | PERSONAL CHROMATICITY COORDINATE VALUES OF OBSERVER B | | | PERSONAL CHROMATICITY COORDINATE VALUES OF OBSERVER C | | | PERSONAL CHROMATICITY COORDINATE VALUES OF OBSERVER C | | |
|---|---|---|---|---|---|---|---|---|---|---|---|---|---|---|
| L* | a* | b* | L* | a* | b* | L* | a* | b* | L* | a* | b* | L* | a* | b* |
| 0.0 | 0.0 | 0.0 | 0.0 | 0.0 | 0.0 | 0.0 | 0.0 | 0.0 | 0.0 | 0.0 | 0.0 | 0.0 | 0.0 | 0.0 |
| 20.0 | 0.0 | 0.0 | 20.0 | 1.0 | 0.6 | 20.0 | 0.2 | 1.0 | 20.0 | 0.3 | 0.2 | 20.0 | 0.8 | 0.4 |
| 40.0 | 0.0 | 0.0 | 40.0 | 1.6 | 0.7 | 40.0 | 0.4 | 1.2 | 40.0 | 0.8 | 0.6 | 40.0 | 1.0 | 0.5 |
| 60.0 | 0.0 | 0.0 | 60.0 | 2.0 | 1.0 | 60.0 | 0.8 | 1.5 | 60.0 | 1.0 | 1.0 | 60.0 | 1.2 | 0.6 |
| 80.0 | 0.0 | 0.0 | 80.0 | 2.5 | 1.2 | 80.0 | 1.0 | 1.6 | 80.0 | 1.2 | 1.0 | 80.0 | 1.5 | 0.8 |
| 100.0 | 0.0 | 0.0 | 100.0 | 3.0 | 1.5 | 100.0 | 1.5 | 2.0 | 100.0 | 1.4 | 1.5 | 100.0 | 2.0 | 0.9 |

FIG. 8

| REFERENCE COLOR CHART (SAMPLE COLORS) | | | GROUP CHROMATICITY COORDINATE VALUES | | |
|---|---|---|---|---|---|
| L* | a* | b* | L* | a* | b* |
| 0.0 | 0.0 | 0.0 | 0.0 | 0.0 | 0.0 |
| 20.0 | 0.0 | 0.0 | 20.0 | 0.6 | 0.6 |
| 40.0 | 0.0 | 0.0 | 40.0 | 1.0 | 0.9 |
| 60.0 | 0.0 | 0.0 | 60.0 | 1.4 | 1.1 |
| 80.0 | 0.0 | 0.0 | 80.0 | 1.8 | 1.2 |
| 100.0 | 0.0 | 0.0 | 100.0 | 2.2 | 1.5 |

FIG. 9

| REFERENCE COLOR CHART (SAMPLE COLORS) | | | CHROMATICITY DIFFERENCE VALUES | | |
|---|---|---|---|---|---|
| L* | a* | b* | L* | a* | b* |
| 0.0 | 0.0 | 0.0 | 0.0 | 0.0 | 0.0 |
| 10.0 | 0.0 | 0.0 | 0.0 | 0.3 | 0.3 |
| 20.0 | 0.0 | 0.0 | 0.0 | 0.6 | 0.6 |
| 30.0 | 0.0 | 0.0 | 0.0 | 0.8 | 0.8 |
| 40.0 | 0.0 | 0.0 | 0.0 | 1.0 | 0.9 |
| 50.0 | 0.0 | 0.0 | 0.0 | 1.2 | 1.0 |
| 60.0 | 0.0 | 0.0 | 0.0 | 1.4 | 1.1 |
| 70.0 | 0.0 | 0.0 | 0.0 | 1.6 | 1.2 |
| 80.0 | 0.0 | 0.0 | 0.0 | 1.8 | 1.2 |
| 90.0 | 0.0 | 0.0 | 0.0 | 2.0 | 1.4 |
| 100.0 | 0.0 | 0.0 | 0.0 | 2.2 | 1.5 |

FIG. 13

| REFERENCE COLOR CHART (SAMPLE COLORS) | | | CHROMATICITY DIFFERENCE VALUES OF PERSON A | | | CHROMATICITY DIFFERENCE VALUES OF PERSON C | | | CHROMATICITY DIFFERENCE VALUES OF PERSON C | | | CHROMATICITY DIFFERENCE VALUES OF PERSON D | | | CHROMATICITY DIFFERENCE VALUES OF PERSON E | | |
|---|---|---|---|---|---|---|---|---|---|---|---|---|---|---|---|---|---|
| L* | a* | b* | L* | a* | b* | L* | a* | b* | L* | a* | b* | L* | a* | b* | L* | a* | b* |
| 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 |
| 10.0 | 0.0 | 0.0 | 0.0 | 0.2 | 0.3 | 0.0 | 0.1 | 0.6 | 0.0 | 0.2 | 0.1 | 0.0 | 0.4 | 0.2 | 0.0 | 0.1 | -0.1 |
| 20.0 | 0.0 | 0.0 | 0.0 | 1.0 | 0.6 | 0.0 | 0.2 | 1.0 | 0.0 | 0.3 | 0.2 | 0.0 | 0.8 | 0.4 | 0.0 | 0.1 | -0.1 |
| 30.0 | 0.0 | 0.0 | 0.0 | 1.2 | 0.7 | 0.0 | 0.3 | 1.1 | 0.0 | 0.4 | 0.3 | 0.0 | 0.9 | 0.5 | 0.0 | 0.2 | -0.2 |
| 40.0 | 0.0 | 0.0 | 0.0 | 1.6 | 0.7 | 0.0 | 0.4 | 1.2 | 0.0 | 0.8 | 0.6 | 0.0 | 1.0 | 0.5 | 0.0 | 0.3 | -0.5 |
| 50.0 | 0.0 | 0.0 | 0.0 | 1.7 | 0.9 | 0.0 | 0.5 | 1.3 | 0.0 | 0.9 | 0.8 | 0.0 | 1.1 | 0.5 | 0.0 | 0.4 | -0.4 |
| 60.0 | 0.0 | 0.0 | 0.0 | 2.0 | 1.0 | 0.0 | 0.8 | 1.5 | 0.0 | 1.0 | 1.0 | 0.0 | 1.2 | 0.6 | 0.0 | 0.6 | -0.3 |
| 70.0 | 0.0 | 0.0 | 0.0 | 2.1 | 1.1 | 0.0 | 0.9 | 1.4 | 0.0 | 1.1 | 1.0 | 0.0 | 1.3 | 0.7 | 0.0 | 0.8 | -0.3 |
| 80.0 | 0.0 | 0.0 | 0.0 | 2.5 | 1.2 | 0.0 | 1.0 | 1.6 | 0.0 | 1.2 | 1.0 | 0.0 | 1.5 | 0.8 | 0.0 | 1.2 | -0.2 |
| 90.0 | 0.0 | 0.0 | 0.0 | 2.8 | 1.4 | 0.0 | 1.2 | 1.7 | 0.0 | 1.3 | 1.1 | 0.0 | 1.7 | 0.9 | 0.0 | 1.4 | -0.4 |
| 100.0 | 0.0 | 0.0 | 0.0 | 3.0 | 1.5 | 0.0 | 1.5 | 2.0 | 0.0 | 1.4 | 1.5 | 0.0 | 2.0 | 0.9 | 0.0 | 1.5 | -0.6 |

FIG. 14

| REFERENCE COLOR CHART (SAMPLE COLORS) | | | DEVIATION VALUES OF PERSON A | | | DEVIATION VALUES OF PERSON B | | | DEVIATION VALUES OF PERSON C | | | DEVIATION VALUES OF PERSON D | | | DEVIATION VALUES OF PERSON E | | |
|---|---|---|---|---|---|---|---|---|---|---|---|---|---|---|---|---|---|
| L* | a* | b* | L* | a* | b* | L* | a* | b* | L* | a* | b* | L* | a* | b* | L* | a* | b* |
| 0.0 | 0.0 | 0.0 | 50.0 | 50.0 | 50.0 | 50.0 | 50.0 | 50.0 | 50.0 | 50.0 | 50.0 | 50.0 | 50.0 | 50.0 | 50.0 | 50.0 | 50.0 |
| 0.0 | 0.0 | 0.0 | 50.0 | 50.0 | 53.1 | 50.0 | 41.8 | 64.7 | 50.0 | 50.0 | 45.4 | 50.0 | 66.3 | 49.2 | 50.0 | 41.8 | 37.6 |
| 0.0 | 0.0 | 0.0 | 50.0 | 63.1 | 54.3 | 50.0 | 42.9 | 64.0 | 50.0 | 45.5 | 44.7 | 50.0 | 58.1 | 49.5 | 50.0 | 40.4 | 37.5 |
| 0.0 | 0.0 | 0.0 | 50.0 | 63.9 | 53.8 | 50.0 | 43.0 | 63.2 | 50.0 | 45.4 | 46.4 | 50.0 | 57.0 | 50.6 | 50.0 | 40.7 | 35.9 |
| 0.0 | 0.0 | 0.0 | 50.0 | 65.0 | 53.2 | 50.0 | 41.9 | 61.3 | 50.0 | 49.6 | 51.6 | 50.0 | 53.5 | 50.0 | 50.0 | 40.0 | 33.9 |
| 0.0 | 0.0 | 0.0 | 50.0 | 65.0 | 54.4 | 50.0 | 41.9 | 60.7 | 50.0 | 49.6 | 52.8 | 50.0 | 53.5 | 48.1 | 50.0 | 40.0 | 34.0 |
| 0.0 | 0.0 | 0.0 | 50.0 | 66.3 | 53.6 | 50.0 | 44.1 | 61.0 | 50.0 | 47.8 | 53.6 | 50.0 | 51.5 | 47.6 | 50.0 | 40.4 | 34.3 |
| 0.0 | 0.0 | 0.0 | 50.0 | 66.6 | 54.9 | 50.0 | 43.4 | 59.5 | 50.0 | 47.3 | 53.4 | 50.0 | 51.2 | 48.8 | 50.0 | 41.5 | 33.5 |
| 0.0 | 0.0 | 0.0 | 50.0 | 67.1 | 54.8 | 50.0 | 42.0 | 60.7 | 50.0 | 45.3 | 51.8 | 50.0 | 50.3 | 48.8 | 50.0 | 45.3 | 33.9 |
| 0.0 | 0.0 | 0.0 | 50.0 | 67.1 | 55.7 | 50.0 | 42.7 | 59.4 | 50.0 | 44.2 | 52.0 | 50.0 | 50.3 | 49.5 | 50.0 | 45.7 | 33.4 |
| 0.0 | 0.0 | 0.0 | 50.0 | 66.8 | 54.4 | 50.0 | 44.3 | 59.3 | 50.0 | 42.8 | 54.4 | 50.0 | 51.8 | 48.4 | 50.0 | 44.3 | 33.5 |
| DEVIATION VALUES (AVERAGE) | | | 50.0 | 62.8 | 53.8 | 50.0 | 43.5 | 60.3 | 50.0 | 47.0 | 50.5 | 50.0 | 53.9 | 49.1 | 50.0 | 42.7 | 36.1 |
| DETERMINATION RESULT | | | SMALL DEVIATION OBSERVER CANDIDATE | | | SMALL DEVIATION OBSERVER CANDIDATE | | | SMALL DEVIATION OBSERVER CANDIDATE | | | SMALL DEVIATION OBSERVER CANDIDATE | | | – | | |

FIG. 15

| | PERSON A | PERSON B | PERSON C | PERSON D | PERSON E |
|---|---|---|---|---|---|
| FRONTAL OBSERVER CANDIDATE | ○ | ○ | ○ | × | × |
| SMALL DEVIATION OBSERVER CANDIDATE | ○ | ○ | ○ | ○ | × |
| NARROWING DOWN RESULT | ○ | ○ | ○ | × | × |

IMAGE PROCESSING APPARATUS AND CONTROL METHOD THEREOF

BACKGROUND OF THE INVENTION

1. Field of the Invention

The present invention relates to an image processing apparatus and a control method thereof.

2. Description of the Related Art

Recently various color correction methods (color conversion methods) to match color reproducibility between different media, such as between a display apparatus and paper, or between a display apparatus and a projector, have been proposed. A method of matching color reproducibility between different media is disclosed, for example, in Japanese Patent Application Laid-open No. H6-333001. In concrete terms, Japanese Patent Application Laid-open No. H6-333001 discloses a method of performing color correction processing on image data to be displayed on a display apparatus or image data to be printed by a printer, so that the XYZ tristimulus values of the colors of the image displayed on the display apparatus and the XYZ tristimulus values of the colors printed by the printer match. Here the XYZ tristimulus values are the standard colors specified by CIE (Commission Internationale de l'Eclairage) that do not depend on a specific medium (e.g. colors that do not depend on a display apparatus). Specifically, the XYZ tristimulus values are psychophysical quantities derived by using the spectral distribution of light that enters the eyes and a color matching function that indicates the visual sensitivity of a person (virtual person) having standard visual characteristics (hereafter called "standard color matching functions").

However visual characteristics differ depending on the person because of such causes the yellowing of the lens of the eyes due to aging and the person difference of photoreceptor cell characteristics. Therefore when an object is observed, different colors may be recognized depending on the person (observer). Further, when two objects having different spectral characteristics are observed, some observers may recognize the colors of objects as different, even if the XYZ tristimulus values of the two objects are the same. For example, the spectral characteristics are completely different between a display apparatus and paper. Therefore even if color correction processing is performed on image data to be displayed on a display apparatus such that an image with colors having the same XYZ tristimulus values as the colors of the image printed on paper is displayed, some observers may recognize a difference in the colors of the displayed image and the colors of the printed image. This phenomena (difference in color appearance depending on the person) is called "observer metamerism".

A technique to control the difference in color appearance of an image due to the difference of the visual characteristics is disclosed, for example, in Japanese Patent Application Laid-open Nos. 2005-109583 and 2009-89364. Specifically, Japanese Patent Application Laid-open Nos. 2005-109583 and 2009-89364 disclose a display apparatus that stores a personal profile of each person, generated by color matching experiments, and displays the image data after performing color correction processing using a personal profile of a person who is an observer. The personal profile is correction data that indicates the visual characteristics of a corresponding person.

SUMMARY OF THE INVENTION

With the prior art described above however, if a plurality of observers simultaneously observe one image, only the difference in color appearance by one observer can be controlled, and a difference in color appearance cannot be controlled for each observer. For example, if observers A to C simultaneously observe one image according to the prior art described above, a color correction processing using a profile of the observer A is performed on the image, and the corrected image data is displayed. In this case, the observers B and C, who have visual characteristics that are different from the observer A, may recognize colors differently from the observer A. Furthermore, even if observer A could recognize the colors of the displayed image and the colors of the printed image as the same colors, the observers B and C may recognize the colors of the displayed image and the colors of the printed image as different colors.

The present invention provides a technique that can control the difference in color appearance depending on each observer when a plurality of observers simultaneously observe one image.

The present invention in its first aspect provides an image processing apparatus comprising:

a storage unit configured to store respective profiles representing visual characteristics of each of a plurality of persons; and a correction unit configured to perform color correction processing on image data on the basis of the plurality of profiles corresponding to the plurality of persons stored in the storage unit.

The present invention in its second aspect provides a control method for an image processing apparatus comprising:

a reading step of reading a plurality of profiles corresponding to a plurality of persons from a storage unit that stores respective profiles representing visual characteristics of each of the plurality of persons; and a correction step of performing color correction processing on image data on the basis of the plurality of profiles read in the reading step.

According to the present invention, a difference in the color appearance, depending on the observer, can be controlled when the plurality of observers observe one image at the same time.

Further features of the present invention will become apparent from the following description of exemplary embodiments with reference to the attached drawings.

BRIEF DESCRIPTION OF THE DRAWINGS

FIG. 5 shows an example of a personal profile according to Embodiment 1;

FIG. 6 shows an example of personal chromaticity coordinate values according to Embodiment 1;

FIG. 8 shows an example of group chromaticity coordinate values according to Embodiment 1;

FIG. 9 shows an example of a group profile according to Embodiment 1;

FIG. 13 shows an example of chromaticity difference values according to Embodiment 2;

FIG. 14 shows an example of deviation values according to Embodiment 2; and

FIG. 15 shows an example of a narrowing down result according to Embodiment 2.

DESCRIPTION OF THE EMBODIMENTS

Embodiment 1

Now an image processing apparatus according to Embodiment 1 of the present invention and a control method thereof will be described. The image processing apparatus according to this embodiment is an apparatus that can execute color correction processing that corrects a difference in color appearance of an image due to the difference of visual characteristics.

<Configuration of Apparatus>

Figure 1:
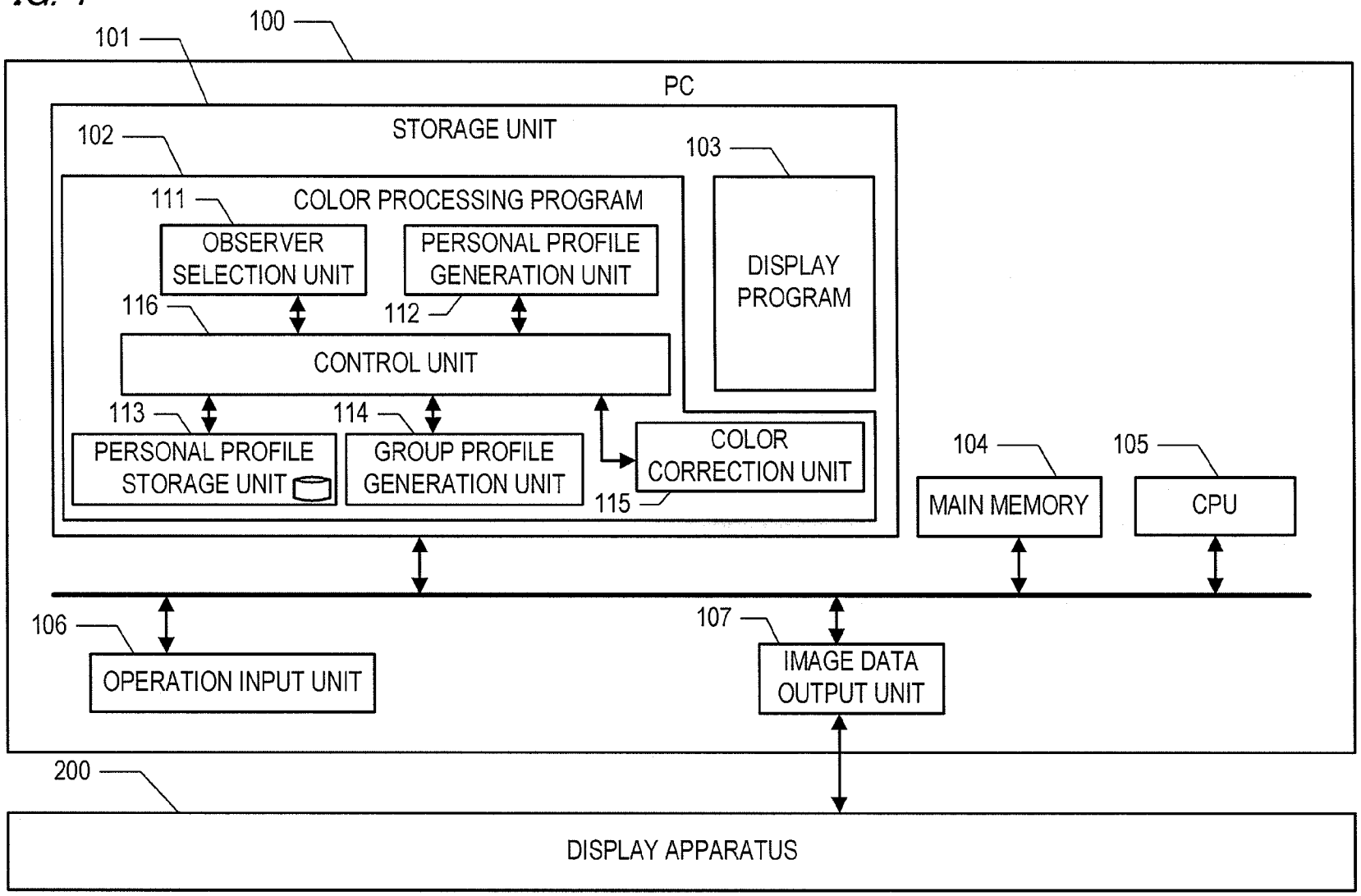
FIG. 1 shows an example of a functional configuration of an image processing apparatus according to Embodiment 1.

FIG. 1 is a block diagram depicting an example of a functional configuration of an image processing apparatus according to this embodiment. The image processing apparatus according to this embodiment is a personal computer (PC) 100 which generates image data, performs color correction processing on the generated-image data, and outputs the color-corrected image data. In this embodiment, the PC 100 is connected to a display apparatus 200, and outputs the image data to the display apparatus 200. The display apparatus 200 is, for example, a liquid crystal display apparatus, an organic EL display apparatus, a plasma display apparatus, a projector or the like, and displays the image data inputted from the PC 100.

In this embodiment, a case of the color correction processing, that is a processing to correct a difference in the color appearance of an image (displayed image) displayed on the display apparatus 200, is described as an example, but the color correction processing is not limited to this processing. The color correction processing may be a processing to correct a difference in the color appearance of an image (printed image) printed on paper.

The PC 100 includes a storage unit 101, a main memory 104, a CPU 105, an operation input unit 106 and an image data output unit 107.

The storage unit 101 is a nonvolatile storage apparatus. For the storage unit 101, a hard disk drive (HDD), a solid state drive (SSD) or the like can be used. Programs and image files are stored in the storage unit 101 in advance. The programs stored in the storage unit 101 are, for example, a color processing program 102 and an image generation program 103.

The image generation program 103 is software to generate image data which is outputted to the display apparatus 200. For example, the image generation program 103 is a GUI generation program, an image editing program or the like. The GUI generation program is software to generate data of graphic user interface (GUI) images, such as a window image and a menu image. The image editing program is software to generate image data by reading an image file stored in the storage unit 101 and decoding that image file, or to edit the generated image data.

The color processing program 102 is software to perform the color correction processing according to this embodiment on image data generated by the image generation program 103.

The main memory 104 is a storage area (work memory) that temporarily stores programs read from the storage unit 101, variables used for processing or the like.

The CPU 105 is a central processor unit (CPU) that executes various control processing operations of the PC 100, and executes the programs stored in the storage unit 101. The CPU 105 loads the programs stored in the storage unit 101 to the main memory 104, and executes the programs.

The operation input unit 106 is a user interface, such as a mouse and keyboard, which the user (operator) uses to operate the PC 100.

The image data output unit 107 is an interface to output image data to the display apparatus 200. In this embodiment, the image data output unit 107 outputs image data, which is generated by the image generation program 103 and which is color-corrected by the color processing program 102, to the display apparatus 200.

By the CPU 105 loading and executing the color processing program 102, an observer selection unit 111, a personal profile generation unit 112, a personal profile storage unit 113, a group profile generation unit 114, a color correction unit 115, a control unit 116 or the like are implemented.

The observer selection unit 111 selects two or more persons from a plurality of persons as observers of a display image. In this embodiment, the observer selection unit 111 selects observers according to the user operation. In concrete terms, N ($N \geq 2$) number of persons have been registered as observer candidates in advance, and the observer selection unit 111 displays a later mentioned observer selection window on the display apparatus 200, so that the user selects M ($N \geq M \geq 2$) number of observers from N number of observer candidates.

The personal profile generation unit 112 performs a color matching experiment (measurement of personal visual characteristics) for a person who is registered as an observer candidate. Then the personal profile generation unit 112 generates the result of the color matching (information that indicates the personal visual characteristics of the person registered as an observer candidate) as a personal profile.

The personal profile storage unit 113 stores a profile to indicate the personal visual characteristics of a person for each of the plurality of persons (observer candidates). In concrete terms, the personal profile storage unit 113 is a data base that stores the personal profiles generated by the personal profile generation unit 112.

The group profile generation unit 114 and the color correction unit 115 perform color correction processing on the image data, based on the average visual characteristics of a plurality of persons (observer candidates), using a plurality of profiles corresponding to the plurality of persons. In this embodiment, the color correction processing is performed on the image data, based on the average visual characteristics of the selected-two or more observers, using the personal profiles of the two or more observers. In concrete terms, the group profile generation unit 114 reads a plurality of personal profiles corresponding to the plurality of observers, from the personal profile storage unit 113. Then based on the plurality of personal profiles, the group profile generation unit 114 generates an average profile of the plurality of observers as a group profile. The color correction unit 115 performs the color correction processing, based on the group profile generated by the group profile generation unit 114, on the image data generated by the image generation program 103.

The control unit 116 controls each functional block (functional blocks other than the control unit 116) which is implemented by executing the color processing program 102. For example, the control unit controls the start and end of processing operations by the functional blocks, the transmission of data between the functional blocks or the like.

In this embodiment, the PC 100 executes the color processing program 102, in other words, the PC 100 executes the color correction processing, but the present invention is not limited to this. For example, the display apparatus 200 may execute the color processing program 102. In other words, the display apparatus 200 may execute the color correction processing.

In this embodiment, the observer selection unit 111 selects a plurality of observers, but the present invention is not limited to this. The observer selection unit 111 may select one observer. In this case, the color correction processing based on the personal profile of this observer is performed on the image data.

In this embodiment, the group profile is generated, but the color correction processing may be executed based on a plurality of profiles without generating the group profile.

<Details on Processing>

Figure 2:
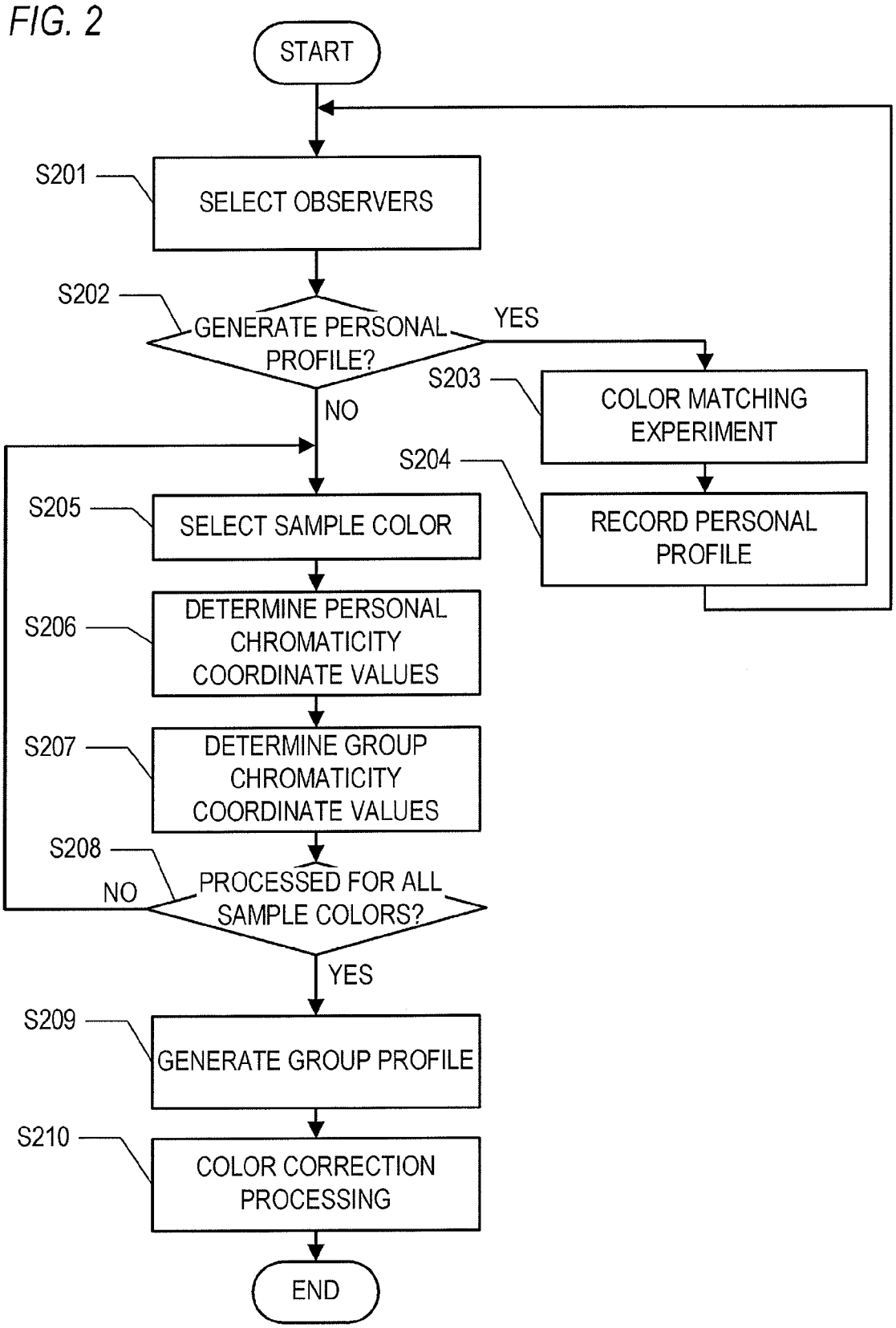
FIG. 2 shows an example of a processing flow executed by a PC according to Embodiment 1.

An example of the processing flow executed by the PC 100 will be described with reference to FIG. 2. Specifically, an example of a processing flow of executing the color processing program 102 will be described. The processing flow in FIG. 2 is started by a user operation that starts processing to optimize the color appearance to a plurality of observers, for example.

Figure 3:
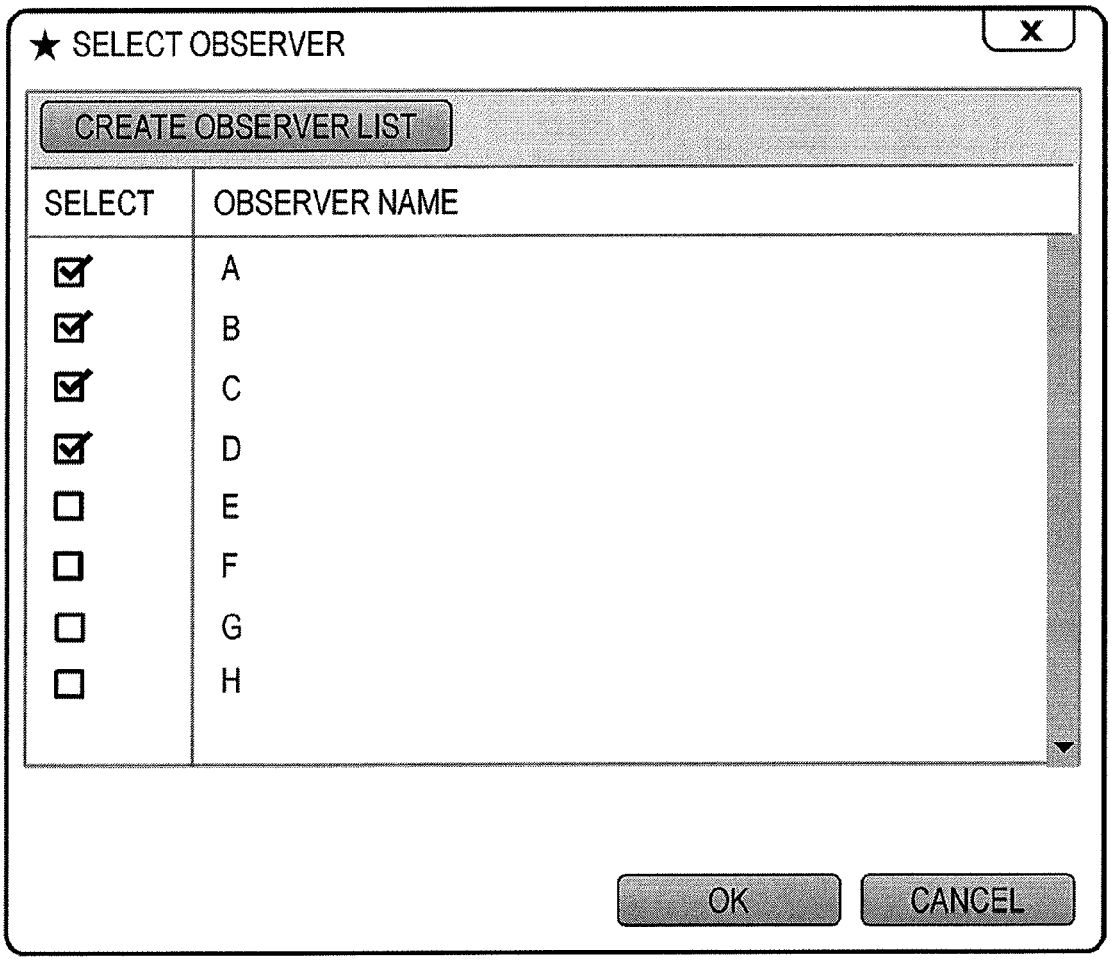
FIG. 3 shows an example of an observer selection window according to Embodiment 1.

First the observer selection unit 111 displays an observer selection window shown in FIG. 3 on the display apparatus 200, so that the user selects persons to be observers (S201). For example, the observer selection unit 111 generates the data of the observer selection window, and the image data output unit 107 outputs the data of the observer selection window to the display apparatus 200. As FIG. 3 shows, in the observer selection window, pre-registered names (or identifiers) of N number of observer candidates are displayed selectively on a list. The user selects the names of the observer candidates to be the observers. In this step, M number of names of observer candidates are selected. In the case of FIG. 3, the user can select the names of observer candidates by checking the boxes displayed on the display.

Then the observer selection unit 111 determines whether a personal profile is generated (S202). If a personal profile is generated, the processing step advances to S203, and if a personal profile is not generated, the processing step advances to S205. As shown in FIG. 3, the observer selection window has a "register button", an "OK button" and a "cancel button". A personal profile of a person registered as an observer candidate has already been generated and stored in the personal profile storage unit 113. The register button is pressed, for example, to allow a person, who is to be selected as an observer and who is not registered as an observer candidate, to be additionally registered as an observer candidate. The OK button is pressed to complete the selection of the names of the observer candidates, for example, in a case where all the persons to be selected as observers are already registered as observer candidates. The cancel button is pressed, for example, when the processing to optimize the color appearance to a plurality of observers is canceled. In this embodiment, the observer selection unit 111 determines that a personal profile is generated when the register button is pressed. The observer selection unit 111 determines that a personal profile is not generated when the OK button is pressed, and selects the observer candidates of the selected names as observers.

If the cancel button is pressed, this flow ends.

In this embodiment, it is determined that a personal profile is generated when an observer candidate is additionally registered, but it may be determined that a personal profile is generated when a personal profile of an observer candidate is updated since personal visual characteristics change with age. The update of the personal profile of the observer candidate may be instructed by the user, or may be determined automatically. For example, it may be determined that a personal profile of an observer candidate is updated when a predetermined time (e.g. one year) has elapsed since this observer candidate was registered.

In S203, the personal profile generation unit 112 performs a color matching experiment on a person who is additionally registered as an observer candidate. In other words, the personal profile generation unit 112 measures the personal visual characteristics of the person who is additionally registered as an observer candidate. Then the personal profile generation unit 112 generates the result of the color matching experiment (information to indicate personal visual characteristics of the person who is registered as an observer candidate) as the personal profile.

The color matching experiment and the personal profile will be described with reference to FIG. 4 and FIG. 5.

Figure 4:
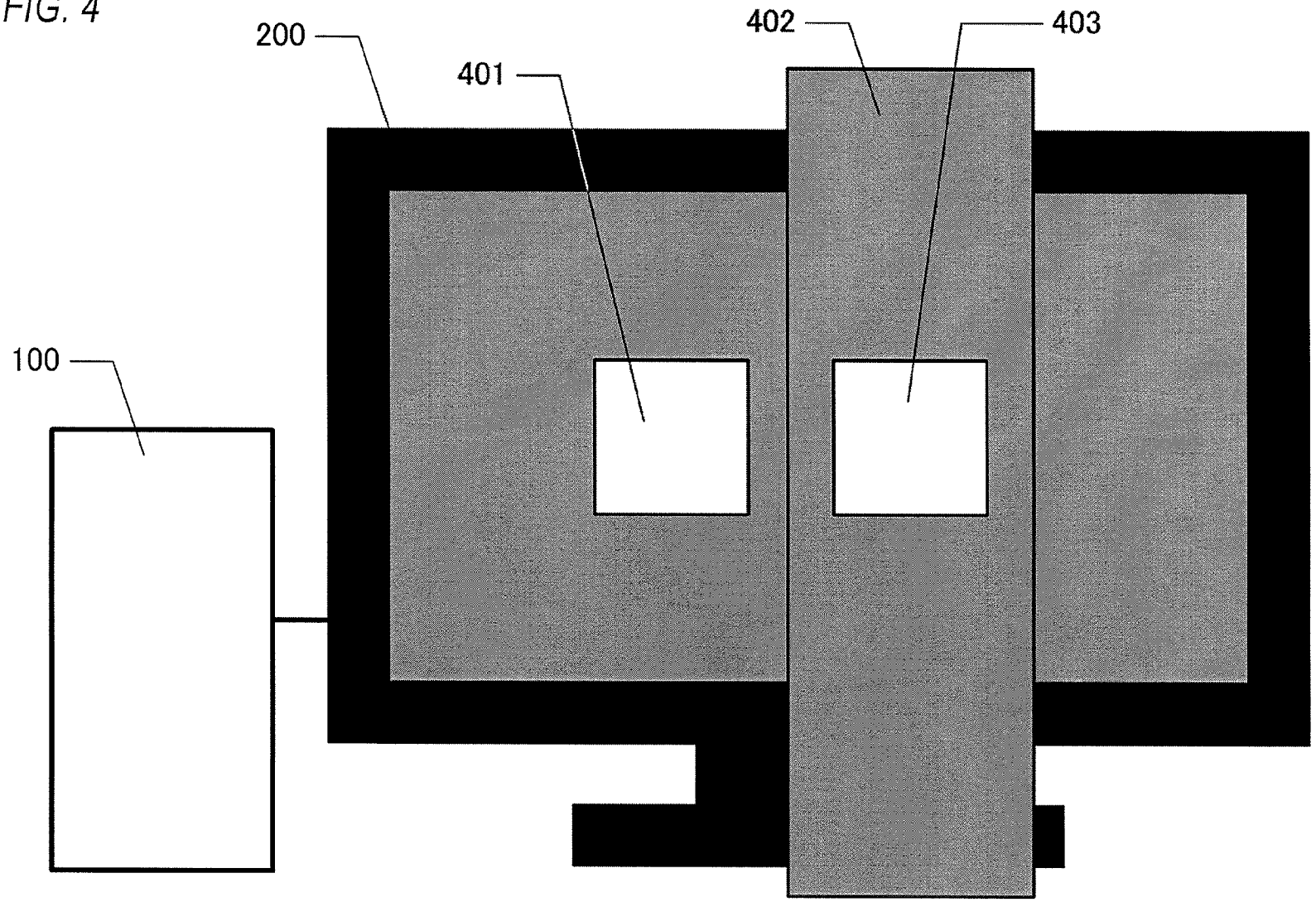
FIG. 4 shows an example of a color matching experiment method according to Embodiment 1.

FIG. 4 is a diagram depicting an example of a color matching experiment method (method of measuring personal visual characteristics). The personal profile generation unit 112 displays a test color chart 401 on the display apparatus 200. At this time, the test color chart 401 is displayed so that the colors of the test color chart 401 can be adjusted by user operation. A reference medium 402 is a reference medium having color reproducibility, which becomes a target color reproducibility of the display apparatus 200, or a medium having spectral characteristics similar to the spectral characteristics of the reference medium. For example, to match the color reproducibility of paper and the display apparatus 200, paper is used as the reference medium. The user adjusts the colors of the test color chart 401 so that the colors of the reference color chart 403 printed (or displayed) on the reference medium 402 and the colors of the test color chart 401 are recognized as the same colors. Then as the personal profile, the personal profile generation unit 112 generates data representing the colors of the test color chart 401, which is acquired when the colors of the reference color chart 403 (predetermined sample colors) and the colors of the test color chart 401 are recognized as the same colors. In other words, data representing the colors by which the corresponding person recognizes the predetermined sample colors is generated as the personal profile. In this embodiment, the colors of the test color chart are adjusted for each of a plurality of reference color charts of which colors are mutually different, so that the colors of the reference color chart and the colors of the test color chart are recognized as the same colors. Then for each of the plurality of reference color charts (a plurality of predetermined sample colors), data representing the colors by which the corresponding person recognizes the colors of the reference color chart is generated as the personal profile. In concrete terms, for each of the plurality of reference color charts, data representing the difference between the adjusted chromaticity coordinate values of the test color chart 401, which are acquired when the colors of the reference color chart and the colors of the test color chart are recognized as the same colors, and unadjusted chromaticity coordinate values of the test color chart (chromaticity difference values), is generated as the personal profile.

FIG. 5 shows an example of a personal profile of one person. In the example in FIG. 5, the personal profile is an look up table (LUT) that indicates the chromaticity difference value for each eleven chromaticity coordinate values corresponding to the eleven reference color charts of which lightness is mutually different. In the case of FIG. 5, the chromaticity coordinate values of the reference color chart are indicated by a L* value, an a* value and a b* value in a Lab color space, and the chromaticity difference values are indicated by a difference of the L* value, a difference of the a* value, and a difference of the b* value. The Lab color space is a color space generated by non-linearly converting the coordinates of the XYZ color space, and the L* component indicates lightness, the a* component indicates hue in the green-red direction, and the b* component indicates hue in the blue-yellow direction. In the example in FIG. 5, the lightness 10 of the colors of the test color chart have been adjusted +0.2 toward red, and +0.3 toward yellow from the colors of the reference color chart, and the adjustment amounts toward red and yellow increase as the lightness is higher. Here the visual characteristics of an observer, which can recognize the colors of the reference color chart and the colors of the test color chart (test color chart displayed with the same image data as the reference color chart) as the same colors without adjusting the test color chart, is called "standard visual characteristics". In the case of FIG. 5, the personal visual characteristics of the target person of the color matching experiment are shifted from the standard visual characteristics by +0.2 toward red and +0.3 toward yellow at the lightness 10. The shift amounts (shift amount from the standard visual characteristics) toward red and toward yellow of the personal visual characteristics of the target person of the color matching experiment increase as the lightness increases.

The method described above has been simplified, and the color matching experiment method is not limited to this method. For example, in order to acquire a more accurate personal profile, the personal profile may be generated by a color matching experiment similar to one for deriving the standard color matching functions (standard visual characteristics). In other words, as color matching functions, the primary color mixing ratio for each wavelength may be derived from the result of a color matching experiment between the primary color mixed light and a single wavelength light, and these color matching functions may be stored in the personal profile.

The personal profile is not limited to the form in FIG. 5, but may be any data if the data represents colors by which a corresponding person can recognize predetermined sample colors. For example, another coordinate system such as the XYZ color space or JCh color space may be used.

The personal profile need not be the chromaticity different values, but may be the chromaticity coordinate values of the test color chart when the colors of the reference color chart and the colors of the test color chart are recognized as the same colors.

The number of the same color may be one.

After S203, the personal profile generation unit 112 records the personal profile generated in S203 in the personal profile storage unit 113 (S204). Then the processing step returns to S201, where the user re-selects a person to be an observer.

In S205 to S208, the group profile generation unit 114 performs color determination processing operations for a part of the plurality of sample colors. The color determination processing is a processing to calculate the chromaticity coordinate values after a group profile is applied (colors represented by the group profile) based on the chromaticity coordinate values after a personal profile is applied (colors represented by the personal profile). In concrete terms, as the colors represented by the group profile, the color determination processing is a processing to determine the average colors of the colors represented by a plurality of personal profiles corresponding to the plurality of selected observers. In this embodiment, it is assumed that a part of the colors (colors to be the target of the color determination processing) are predetermined in advance. In concrete terms, the color determination processing is performed for the following six chromaticity coordinate values of six types of reference color charts: (0,0,0), (20,0,0), (40,0,0), (60,0,0), (80,0,0), and (100,0,0).

The number of colors and the types of colors to be the target of the color determination processing are not limited to the six types mentioned above. For example, if the color determination processing is performed for all the sample colors (all the reference color charts), a more accurate group profile can be generated. If all the reference color charts included in the personal profile are used, an even more accurate group profile can be generated. If the image data to be the target of the color correction processing (image data to be observed) is predetermined, a color representing the image data may be selected as a target of the color determination processing. Thereby, a group profile specific to the observation target image data can be generated. The color representing the image data is, for example, a color used in a predetermined number of pixels or more, an average color of the colors of each pixel, or an intermediate color of colors of each pixel.

In S205, the group profile generation unit 114 selects one color out of the sample colors to be the target of the color determination processing.

In S206, the group profile generation unit 114 determines the chromaticity coordinates values for each observer after applying the personal profile on the sample color selected in S205 (color represented by the personal profile: personal chromaticity coordinate values). In this embodiment, the sample color is a color of the reference color chart, and the personal chromaticity coordinate values are the values acquired by adding the chromaticity difference values to the chromaticity coordinate values of the reference color chart. FIG. 6 shows the personal chromaticity coordinate values determined (calculated) from the personal profiles of the observers A, B, C and D.

The sample color and the color of the reference color chart may be different. In this case, the personal chromaticity coordinate values corresponding to the sample color can be determined by interpolation or extrapolation from the personal chromaticity coordinate values corresponding to the color of the reference color chart.

In S207, the group profile generation unit 114 determines chromaticity coordinate values after applying the group profile (colors represented by the group profile: group chromaticity coordinate values) (color determination processing). In this embodiment, colors represented by a group profile is determined so as to minimize the maximum value of a distance in a predetermined color space between a plurality of colors represented by a plurality of personal profiles corresponding to a plurality of observers and colors represented by the group profile. In concrete terms, the group chromaticity coordinate values Lg, ag and bg are calculated using the following Expression 1. In Expression 1, Lmax is a maximum value of personal L* values (L* values of personal chromaticity coordinate values) of the plurality of observers, amax is a maximum value of personal a* values (a* values of personal chromaticity coordinate values) of the plurality of observers, and bmax is a maximum value of personal b* values (b* values of personal chromaticity coordinate values) of the plurality of observers. Lmin is a minimum value of the personal L* values, (L* values of personal chromaticity coordinate values), of the plurality of observers, amin is a minimum value of the personal a* values (a* values of personal chromaticity coordinate values) of the plurality of observers, and bmin is a minimum value of the personal b* values (b* values of personal chromaticity coordinate values) of the plurality of observers.

$$Lg=(L\max+L\min)/2$$

$$ag=(a\max+a\min)/2$$

$$bg=(b\max+b\min)/2 \qquad \text{(Expression 1)}$$

The group chromaticity coordinate values Lg, ag and bg, determined by using Expression 1, are the points where the maximum value of the three-dimensional distance in the Lab color space from the personal chromaticity coordinate values determined in S206 becomes the minimum. According to the CIEΔE1976 color difference expression, the color difference ΔE between two points (L1, a1, b1) and (L2, a2, b2) in the Lab color space can be calculated by the following Expression 2, and is equal to the three-dimensional distance in the Lab color space.

$$\Delta E=((L1-L2)2+(a1-a2)2+(b1-b2)2)^{1/2} \qquad \text{(Expression 2)}$$

Figure 7:
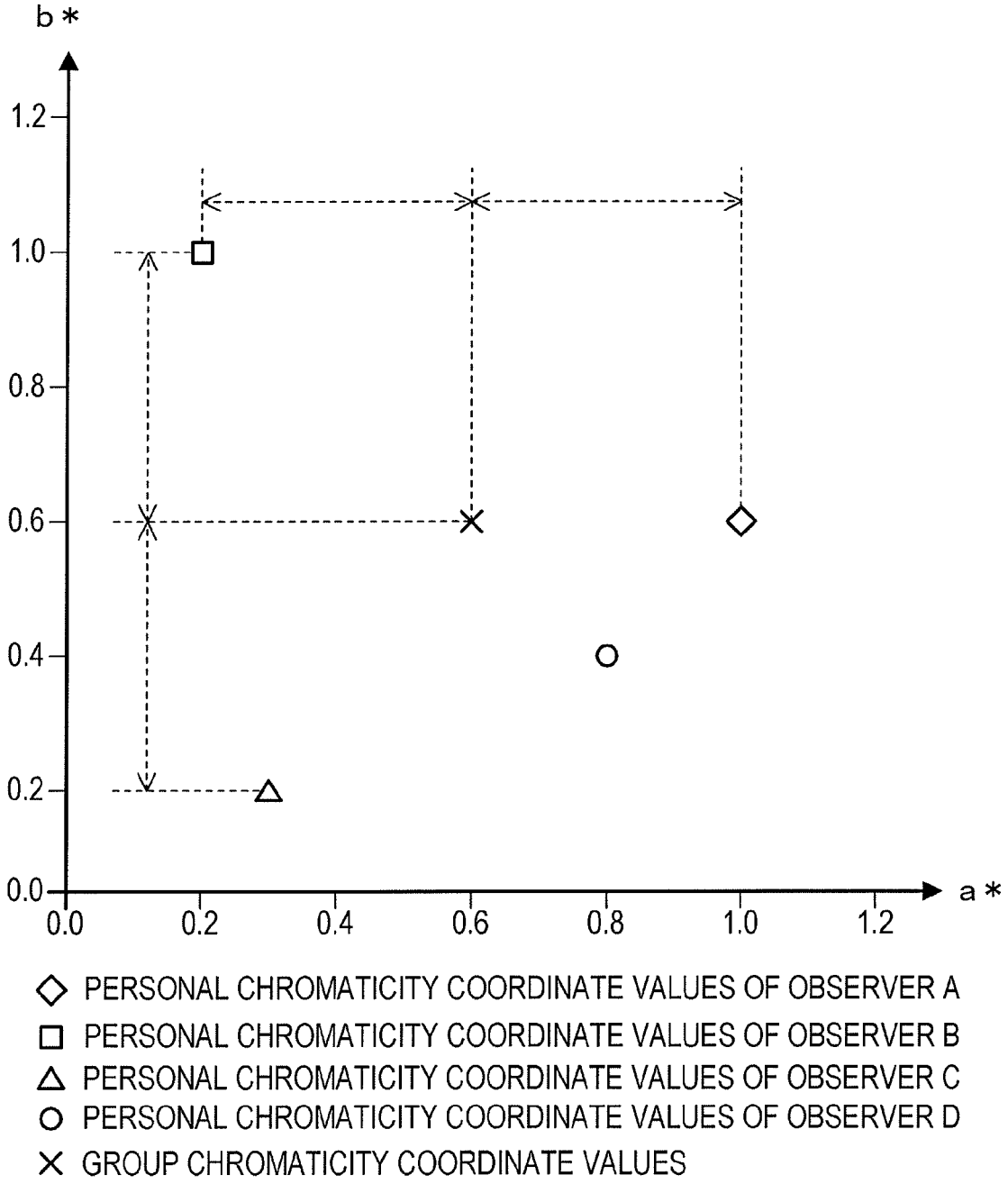
FIG. 7 shows an example of a positional relationship of personal chromaticity coordinate values and group chromaticity coordinate values according to Embodiment 1.

Therefore the point (Lg, ag, bg) determined using Expression 1 is a point where the maximum value of the color difference from the chromaticity coordinate values after applying the personal profile of the observer becomes the minimum. FIG. 7 shows a positional relationship on the a*b* chromaticity diagram between the group chromaticity coordinate values determined for the sample color (20,0,0) in FIG. 6 and the personal chromaticity coordinate values of the observers A, B, C and D. In the case of FIG. 7, amax is the personal a* value of the observer A, that is "1.0", and amin is the personal a* value of the observer B, that is "0.2", therefore ag, which is an a* value in the group chromaticity coordinate values, is 0.6 (=(1.0+0.2)/2). In the case of FIG. 7, bmax is the personal b* value of the observer B, that is "1.0", and bmin is the personal b* value of the observer C, that is "0.2", therefore bg, which is a b* value in the group chromaticity coordinate values, is 0.6 (=(1.0+0.2)/2). In the same manner, Lg, which is a L* value in the group chromaticity coordinate values, is calculated. FIG. 8 shows the group chromaticity coordinate values for each sample color determined from the personal chromaticity coordinate values in FIG. 6 using Expression 1.

In the color difference expressions that are more recent than CIEΔE1976, such as CIEΔE1994 and CIEΔE2000, the color difference calculation method is more complicated, but color difference is still represented by the distance in the three-dimensional space generated by non-linearly converting the Lab color space. In this case, the group chromaticity coordinate values can be calculated by substituting the L* component, the a* component and the b* component in Expression 1 for the axis components in the space after the conversion.

The color determination processing method is not limited to the above method.

For example, Lg may be an average value of the personal L* values of the selected four observers A to D, ag may be an average value of the personal a* values of the observers A to D, and bg may be an average value of the personal b* value of the observers A to D. In concrete terms, it is assumed that the personal chromaticity values of the observer A are (LA, aA, bA), the personal chromaticity coordinate values of the observer B are (LB, aB, bB), the personal chromaticity values of the observer C are (LC, aC, bC), and the personal chromaticity coordinate values of the observer D are (LD, aD, bD). In this case, Lg=(LA+LB+LC+LD)/4, ag=(aA+aB+aC+aD)/4, and bg=(bA+bB+bC+bD)/4 may be established.

The personal L* values used for the calculating Lg are not limited to Lmax and Lmin. For example, if three or more observers are selected, a personal L* value (Lmax2) that is the greatest value next to Lmax, a personal L* value (Lmin2) that is the smallest next to Lmin, may be used out of the personal L* values of the plurality of observers, or an intermediate value of the personal L* values of the plurality of observers may be used. If Lmax, Lmax2 and Lmin are used to calculate Lg, then Lg can be calculated, for example, by using expression Lg=((Lmax+Lmax2+Lmin)/3). If Lmax, Lmax2, Lmin and Lmin2 are used to calculate Lg, then Lg can be calculated, for example by using Lg=((Lmax+Lmax2+Lmin+Lmin2)/4). This applies to ag and bg as well.

The distance between colors is not limited to a distance in the Lab color space. For example, a distance in another color space, such as the XYZ color space and the JCh color space may be used.

In S208, the group profile generation unit 114 determines whether the group chromaticity coordinate values were determined for all of the selected colors (color determination processing target sample colors). If a sample color of which group chromaticity coordinate values are not selected exists in the color determination processing target sample colors, the processing step returns to S205, where the sample color, of which group chromaticity coordinate values are not determined, is selected as the color determination processing target. If the group chromaticity coordinate values are determined for all the color determination processing target sample colors, the processing step advances to S209.

In S209, the group profile generation unit 114 generates a group profile. In this embodiment, the color determined in S207 is used for the color determination processing target sample color, as the color represented by the group profile. For the rest of the sample colors (sample colors outside the color determination processing targets), the colors represented by the group profile are determined by interpolation or extrapolation. In concrete terms, for the sample colors of which group chromaticity coordinate values are determined, the difference between the chromaticity coordinate values of the sample color and the group chromaticity coordinate values is calculated as the chromaticity difference values of th group profile. For the rest of the sample colors, the chromaticity difference values of the group profile is calculated by interpolation or extrapolation. FIG. 9 shows the stored values of a group profile calculated using the group chromaticity coordinate values in FIG. 8 (chromaticity difference values for each chromaticity coordinate value of the reference color chart (that is, the chromaticity coordinate values of the sample color)). FIG. 9 is an example when the chromaticity difference values of the group profile were calculated for the sample colors outside the color determination processing targets, using a linear interpolation method. The method of interpolation or extrapolation is not limited to a linear interpolation method. For example, for the sample colors outside the targets, the chromaticity difference values of the group profile may be calculated using a high order function.

Then the color correction unit 115 performs the color correction processing, which is based on the group profile generated in S209, on the image data generated by the image generation program 103, so as to generate the display image data (S210). The display image data is outputted to the display apparatus 200 via the image data output unit 107, and is displayed.

As described above, according to this embodiment, the color correction processing, which is based on the average visual characteristics of a plurality of observers, is performed on the image data using the plurality of personal profiles corresponding to the plurality of observers. Thereby a difference in the color appearance, depending on the observer, can be controlled when the plurality of observers observe one image at the same time. Moreover, when the plurality of observers observe one image at the same time, all the observers can observe the image with color reproduction characteristics similar to the reference medium.

The color correction processing based on the average visual characteristics of all of the plurality of persons (observer candidates) may be performed on the image data using a plurality of profiles corresponding to the plurality of persons. For example, the color correction processing based on the average visual characteristics of all the eight observer candidates A to H shown in FIG. 3 may be performed on the image data, using the profiles of all the eight observer candidates A to H. By this configuration as well, an effect similar to the above mentioned effect can be expected. However if the number of observers (persons who are considered when a group profile is generated) are narrowed down, a more accurate group profile can be generated. In the case of this configuration, the observer selection unit 111 is unnecessary.

Embodiment 2

Now an image processing apparatus according to Embodiment 2 of the present invention and a control method thereof will be described. In Embodiment 1, an example of selecting a plurality of persons to be observers in accordance with the user operation was described. In this embodiment, an example of selecting persons to be observers based on the positional relationship between a person and the display apparatus (display apparatus that displays color-corrected image data) and the deviation from the average visual characteristics of a plurality of persons (observer candidates) will be described.

<Configuration of Apparatus>

Figure 10:
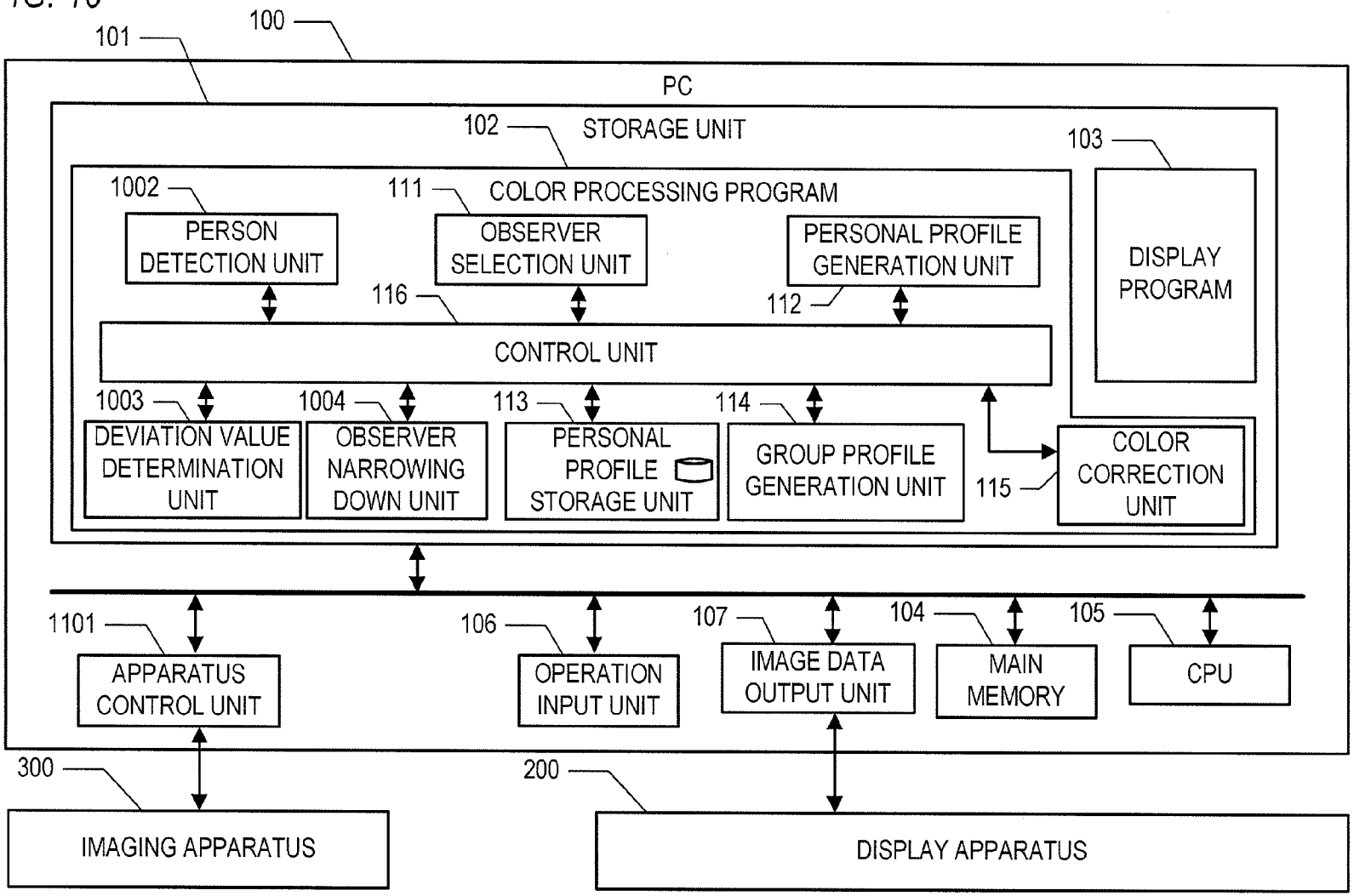
FIG. 10 shows an example of a functional configuration of an image processing apparatus according to Embodiment 2.

FIG. 10 is a block diagram depicting an example of a functional configuration of an image processing apparatus according to this embodiment. A function the same as Embodiment 1 is denoted with the same reference symbol, for which description is omitted.

An imaging apparatus 300 is a camera that photographs an area in front of the display apparatus 200 (display apparatus that displays color-corrected image data).

Figure 11:
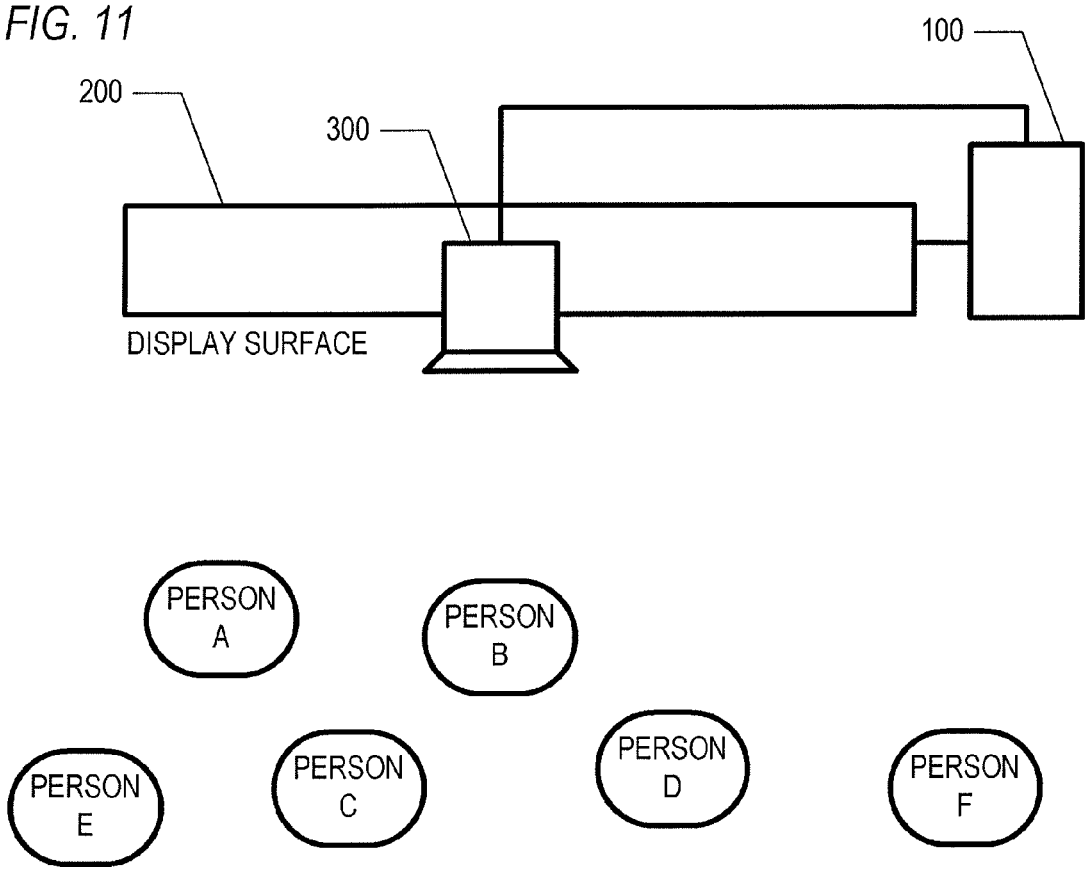
FIG. 11 shows an example of positional relationships of a display apparatus, an imaging apparatus and persons according to Embodiment 2.

An apparatus control unit 1001 controls in accordance with the color processing program 102 the photographing by the imaging apparatus 300 and the acquisition of image data (image data generated by photographing) by the imaging apparatus 300. In concrete terms, the color processing program 102 (person detection unit 1002) outputs a photographing instruction to the apparatus control unit 1001. The apparatus control unit 1001 allows the imaging apparatus 300 to photograph according to a photographing instruction, and to acquire the image data from the imaging apparatus 300. FIG. 11 shows an example of a positional relationship of a display apparatus 200, the imaging apparatus 300 and persons. FIG. 11 shows the apparatuses viewed from the top, where six persons A to F exist in front of the display apparatus 200. The imaging apparatus 300 is installed at the center of the upper part of the display apparatus 200, and photographs an area in front of the display apparatus 200.

An person detection unit 1002 outputs a photographing instruction to the apparatus control unit 1001, and acquires imaging data via the apparatus control unit 1001. Then the person detection unit 1002 detects (identifies) from imaging data the observer candidates who exist in front of the display apparatus 200 (first identification processing). All of the photographed observer candidates may be detected, or the observer candidates photographed in a part of the photographing area may be detected.

A deviation determination unit 1003 calculates the deviation from the average visual characteristics of a plurality of observers for each observer candidate, using a plurality of personal profiles corresponding to a plurality of persons (observer candidates). Then the deviation determination unit 1003 identifies a person (observer candidate) having personal visual characteristics of which an absolute value of deviation is less than a predetermined value (second deviation processing).

An observer narrowing down unit 1004 selects the persons (observer candidates) identified in both the first identification processing and in the second identification processing as observers. In this embodiment, the observer narrowing down unit 1004 narrows down the number of persons selected as observers by user operation ("user-selected persons"). In concrete terms, the observer narrowing down unit 1004 selects the persons identified in both the first identification processing and the second identification processing, out of the user-selected persons.

<Details of Processing>

Figure 12:
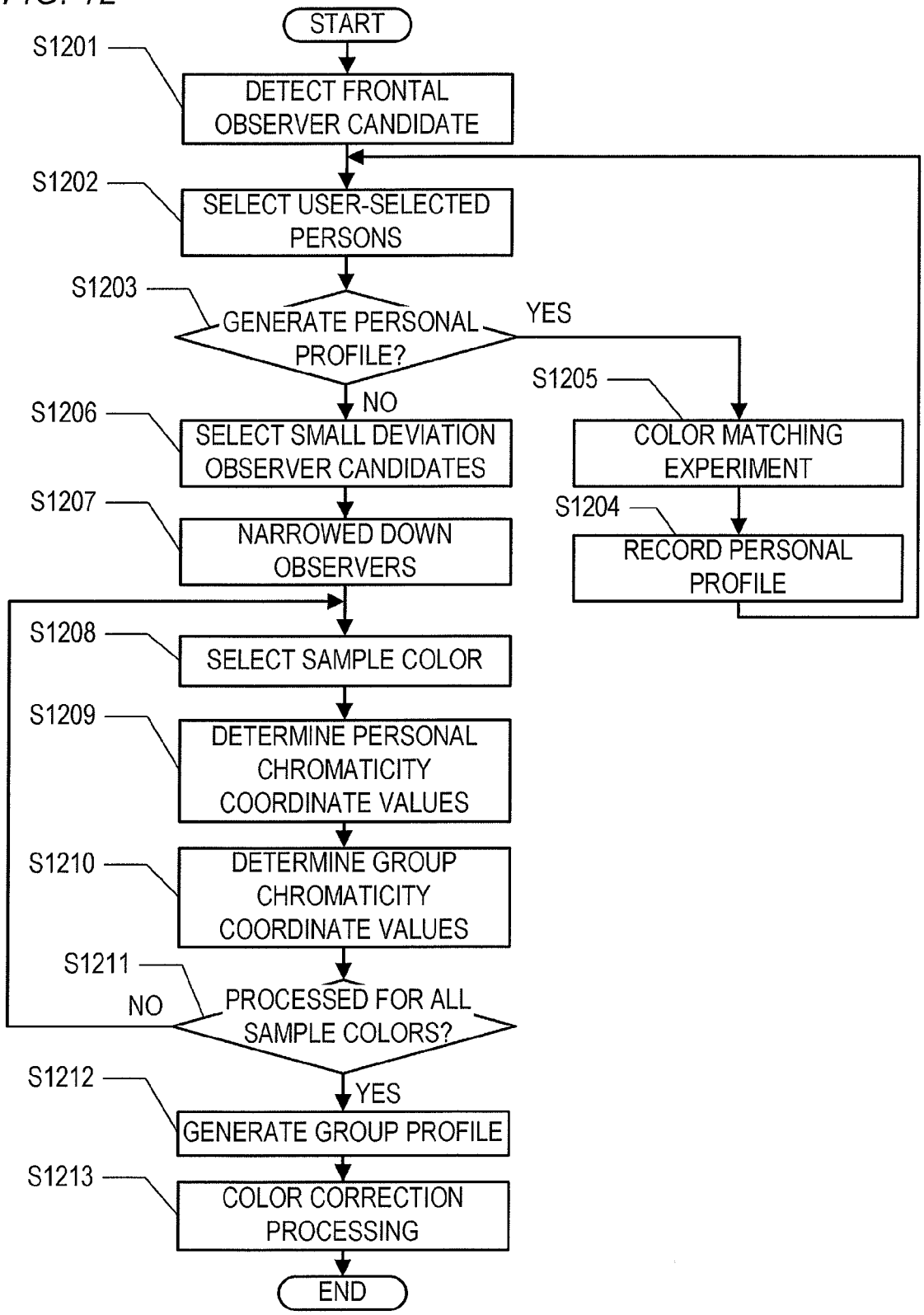
FIG. 12 shows an example of a processing flow executed by a PC according to Embodiment 2.

An example of the processing flow executed by the PC 100 according to Embodiment 2 will be described with reference to FIG. 12. In concrete terms, an example of the processing flow performed by executing a color processing program 102 will be described. The processing flow in FIG. 12 is started by a user operation that starts processing to optimize the color appearance to a plurality of observers, for example.

First the person detection unit 1002 outputs a photographing instruction to the apparatus control unit 1001, and acquires the image data via the apparatus control unit 1001. Then the person detection unit 1002 analyzes the image data and detects (identifies) the observer candidates who exist in front of the display apparatus 200 (S1201). In concrete terms, in this embodiment, the person identification information of each observer candidate (information representing the characteristics of the observer candidate) has been recorded in the personal profile storage unit 113. The person detection unit 1002 analyzes the photographed data, and detects a photographed person. The person detection unit 1002 compares the characteristics of the detected person and personal identification information of each observer candidate, and specifies the detected person. In other words, a detected person is determined from the observer candidates. Then based on the position of the detected observer candidate, the person detection unit 1002 selects observer candidates who exist in front of the display apparatus 200 ("frontal observer candidates"), out of the detected observer candidates. In the case of FIG. 11, the persons A, B, C and D are selected out of the detected persons A, B, C, D, E and F as the frontal observer candidates.

The characteristics of a person are, for example, a facial image of the person or the facial characteristics of the person. The personal identification information is, for example, a facial image of the corresponding observer candidate, or information to represent the facial characteristics of the corresponding observer candidate. The personal identification information is included in a personal profile, for example. The processing to detect photographed persons and the processing to determine a detected person from the observer candidates are performed using an existing facial analysis technique, for example.

Then the processing in S1202 is executed. Since the processing in S1202 is the same as the processing in S201 of Embodiment 1 (FIG. 2), description thereof is omitted. However in S1202, the user may select persons from the frontal observer candidates selected in S1201 (persons identified in the first identification processing). The user may select persons from the persons selected in the later mentioned S1206 (person identified in the second identification processing). The user may also select persons from the persons selected in both S1201 and S1206 (persons identified in both the first identification and the second identification processing operations). Here it is assumed that the user selected the persons A, B, C, D and E from all the observer candidates.

Then the processing in S1203 is executed. Since the processing in S1203 is the same as the processing in S202 of Embodiment 1 (FIG. 2), the description thereof is omitted. If a personal profile is generated, the processing operations in S1204 and S1205 are executed, then the processing step is returned to S1202. If a personal profile is not generated, the processing step advances to S1206. Since the processing in S1204 and S1205 are the same as the processing operations in S203 an S204 of Embodiment 1 (FIG. 2), description thereof is omitted.

In S1206, the deviation determination unit 1003 calculates the deviations for the persons the user selected in S1202, and selects the user-selected persons whose absolute value of the deviation is less than a predetermined value, as the small deviation observer candidates. Deviation may be calculated for the frontal observer candidates selected in S1201, or deviation may be calculated for the observer candidates selected in S1201 and in S1202 as well. Deviation may be calculated for all the observer candidates. In concrete terms, the deviation determination unit 1003 calculates the deviation values using the following Expression 3 for each user-selected person. A deviation value Tli is a deviation value of an L* component of a person i. A deviation value Tai is a deviation value of an a* component of the person i. Tbi is a deviation value of a b* component of the person i. Then the deviation determination unit 1003 selects the person i of which deviation values TLi, Tai and Tbi are within a predetermined range, as the small deviation observer candidates.

[Math. 1]

$$TLi = \frac{\sum_{j=1}^{P}\left(\frac{10(Lij - L\mu j)}{\sigma \mathrm{Lj}} + 50\right)}{P} \qquad \text{(Expression 3)}$$

$$Tai = \frac{\sum_{j=1}^{P}\left(\frac{10(aij - a\mu j)}{\sigma aj} + 50\right)}{P}$$

$$Tbi = \frac{\sum_{j=1}^{P}\left(\frac{10(bij - b\mu j)}{\sigma bj} + 50\right)}{P}$$

In Expression 3, Lij, aij and bij denote chromaticity difference values (L* component, a* component and b* component) of the person i, and are the chromaticity difference values with respect to a reference color chart j (j is an integer of 1 or more, P or less). Lμj, aμj and bμj denote average chromaticity coordinate values of the personal chromaticity coordinate values of all the observer candidates (average chromaticity coordinate values), and are the average chromaticity coordinate values with respect to the reference color chart j. σLj, σaj and σbj denote standard deviations. The method of calculating the average chromaticity coordinate values is not especially limited. For example, the average chromaticity coordinate values may be an average value of the personal chromaticity coordinate values of all the observer candidates, or may be calculated using Expression 1.

The deviation values TLi, Tai and Tbi calculated by Expression 3 are arithmetic mean values of the deviation values for each reference color chart. For example, if the personal visual characteristics are an average of the visual characteristics of all the observer candidates, then TLi=50, Tai=50 an Tbi=50. FIG. 13 shows an example of chromaticity difference values (chromaticity difference values for each reference color chart) of the persons A, B, C, D and E. FIG. 14 shows an example of the deviation values of the persons A, B, C, D and E. In concrete terms, FIG. 14 shows an example of the deviation values for each reference color chart and final deviation values (arithmetic mean values of the deviation values for each reference color chart). If the chromaticity difference values are the values shown in FIG. 13, the deviation values are the values shown in FIG. 14. According to FIG. 14, the deviation values (TLi, Tai, Tbi) of the person A to E are (50.0, 62.8, 53.8) (50.0, 43.5, 60.3) (50.0, 47.0, 50.5), (50.0, 53.9, 49.1) and (50.0, 42.7, 36.1) respectively. If the persons of which TLi, Tai and Tbi are within a 40 to 60 range are selected as the small deviation observer candidates, then the persons A, B, C and D are selected as the small deviation observer candidates.

The purpose here is to remove the persons, of which visual characteristics are clearly different from the visual characteristics of other persons, from the observer candidates, and the method of selecting the small deviation observer candidates (the method of calculating the deviation values, the range of deviations to select the small deviation observer candidates or the like) is not limited to the above mentioned method. For example, "+50" in Expression 3 may be omitted. In this case, the deviations are acquired as TLi, Tai and Tbi, so a person i, of which absolute value of TLi, absolute value of Tai and absolute value of Tbi are less than a predetermined value, is selected as the small deviation observer candidates.

After S1206, the observer narrowing down unit 1004 narrows down the user-selected persons selected in S1202, based on the selection results in S1201 and S1206, so as to determine the observers (S1207). In concrete terms, out of the user-selected persons selected in S1202, the user-selected persons as the frontal observer selected in S1201, and selected as small deviation observer candidates in S1206 are selected as the observers. In other words, the persons (observer candidates) who were selected as the frontal observer candidates in S1201, and selected as the small deviation observer candidates in S1206, out of the persons selected as the user-selected persons in S1202, are selected as the observers. FIG. 15 shows an example of the narrowing down result. FIG. 15 is a case when the persons λ to E were selected as the user-selected persons. In the case of FIG. 15, the persons A, B and C who were the frontal observer candidates and the small deviation observer candidates are selected as the observers after the narrowing down process.

After S1207, the processing operations in S1208 to S1213 are executed. Since the processing operations in S1208 to S1213 are the same as the processing operations in S205 to S210 of Embodiment 1 (FIG. 2), the description thereof is omitted. Except that in S1209 and unlike S206, the personal chromaticity coordinate values are calculated for the observers selected in S1207.

As described above, according to this embodiment, persons to be the observers are selected based on the positional relationship between each person and the display apparatus, and deviation from the average visual characteristics of a plurality of persons. Thereby the difference in color appearance depending on the observer can be controlled more. For example, person located at positions where accurate observation is difficult are more likely not to view an image, where color reproduction processing (processing to make colors closer to the color reproduction characteristics of the reference medium) is not very effective for such persons. Further, if the visual characteristics of persons, of which visual characteristics are obviously different from that of other persons, are considered when a group profile is created, the accuracy of the color reproduction processing for the other persons diminishes. According to this embodiment, such persons can be removed from the observers group. As a result, persons appropriate as observers can be selected, therefore the accuracy of the color reproduction processing for each observer can be further enhanced, and the difference in color appearance depending on the observer can be controlled more.

Individuals who are at least identified in the first identification processing may be selected as the observers. In this case, the deviation determination unit 1003 is unnecessary. Individuals who are at least identified in the second identification processing may be selected as the observers. In this case, the person detection unit 1002 is unnecessary. However if both of the processing results of the first identification processing and the second identification processing are considered, the difference in color appearance depending on the observer can be controlled more than the case of considering only one processing result.

In this embodiment, an example of narrowing down the persons selected as observers by user operation (user-selected persons) was shown, but the present invention is not limited to this configuration. Individuals to be observers may be selected out of the plurality of observer candidates based on the positional relationship with respect to the display apparatus or deviation of visual characteristics. However if the user operation to select persons as the observers is considered, the difference in color appearance depending on the observer can be controlled more compared with the case of not considering the user operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s).

This application claims the benefit of Japanese Patent Application No. 2013-101114, filed on May 13, 2013, which is hereby incorporated by reference herein in its entirety.

What is claimed is:

1. A control method for an image processing apparatus comprising:

a reading step of reading a plurality of profiles corresponding to a plurality of persons from a storage unit that stores respective profiles representing visual characteristics of each of the plurality of persons;

a correction step of performing color correction processing on image data on the basis of the plurality of profiles read in the reading step; and an output step of outputting the image data, on which the color correction processing is performed, to a display unit, wherein in the correction step, color correction processing based on average visual characteristics of the plurality of persons is performed on the image data by using the plurality of profiles read in the reading step.

2. The control method for an image processing apparatus according to claim 1, wherein in the correction step, color correction processing based on the average visual characteristics of all of the plurality of persons is performed on the image data by using the plurality of profiles read in the reading step.

3. The control method for an image processing apparatus according to claim 1, further comprising, a selection step of selecting two or more persons from the plurality of persons, wherein in the correction step, color correction processing based on average visual characteristics of the two or more persons is performed on the image data by using the profiles of the two or more persons selected in the selection step, out of the plurality of profiles.

4. The control method for an image processing apparatus according to claim 3, wherein in the selection step, a person is selected in accordance with a user operation.

5. The control method for an image processing apparatus according to claim 3, wherein in the selection step, a person located in front of a display apparatus is selected, the display apparatus displaying the image data on which color correction processing was performed.

6. The control method for an image processing apparatus according to claim 3, wherein in the selection step, a person having visual characteristics, of which absolute value of deviation from the average visual characteristics of the plurality of persons, is less than a predetermined value is selected on the basis of the plurality of profiles.

7. The control method for an image processing apparatus according to claim 3, wherein in the selection step, first identification processing is performed to identify a person located in front of a display apparatus, the display apparatus displaying the image data on which color correction processing was performed, second identification processing is performed to identify a person having visual characteristics, of which absolute value of deviation from the average visual characteristics of the plurality of persons, is less than a predetermined value, based on the plurality of profiles, and a person identified in both the first identification processing and the second identification processing is selected.

8. The control method for an image processing apparatus according to claim 1, wherein the correction step includes:

a generation step of generating an average profile of the plurality of persons as a group profile, on the basis of the plurality of profiles; and a color correction step of performing color correction processing on the image data, on the basis of the group profile generated in the generation step.

9. The control method for an image processing apparatus according to claim 8, wherein the profile represents color allowing a corresponding person to recognize predetermined sample color, and in the generation step, a group profile is generated by performing color determination processing for determining an average color of a plurality of colors, represented by the plurality of profiles, as a color represented by the group profile.

10. The control method for an image processing apparatus according to claim 9, wherein the profile represents respective colors to allow a corresponding person to recognize each of a plurality of predetermined sample colors, and in the generation step, a group profile is generated by performing the color determination processing for each of the plurality of sample colors.

11. The control method for an image processing apparatus according to claim 9, wherein the profile represents respective colors to allow a corresponding person to recognize each of a plurality of predetermined sample colors, and in the generation step, a group profile is generated by performing the color determination processing for a part of the colors out of the plurality of sample colors, and determining colors represented by the group profile by interpolation or extrapolation for the rest of the plurality of sample colors.

12. The control method for an image processing apparatus according to claim 11, wherein the part of the colors is predetermined.

13. The control method for an image processing apparatus according to claim 11, wherein the part of the colors are colors that represent image data on which the color correction processing is performed.

14. The control method for an image processing apparatus according to claim 8, wherein the color determination processing is processing to determine colors represented by the group profile, so as to minimize the maximum value of distances between a plurality of colors represented by the plurality of profiles and color represented by the group profile in a predetermined color space.

15. A non-transitory computer readable recording medium, storing a program for a computer to execute each step of a control method for an image processing apparatus, wherein the control method comprises a reading step of reading a plurality of profiles corresponding to a plurality of persons from a storage unit that stores respective profiles representing visual characteristics of each of the plurality of persons a correction step of performing color correction processing on image data on the basis of the plurality of profiles read in the reading step; and an output step of outputting the image data, on which the color correction processing is performed, to a display unit, and in the correction step, color correction processing based on average visual characteristics of the plurality of persons is performed on the image data by using the plurality of profiles read in the reading step.

16. An image processing apparatus comprising:

a storage unit configured to store respective profiles representing visual characteristics of each of a plurality of persons;

a correction unit configured to perform color correction processing on image data on the basis of the plurality of profiles corresponding to the plurality of persons stored in the storage unit; and an output unit configured to output the image data, on which the color correction processing is performed, to a display unit, wherein the correction unit performs color correction processing based on average visual characteristics of the plurality of persons, on the image data by using the plurality of profiles stored by the storage unit.

* * * * *